US005617810A

United States Patent [19]

Sauerwein

[11] Patent Number: 5,617,810

[45] Date of Patent: Apr. 8, 1997

[54] COMPACT SEMI-COLLAPSIBLE WATERCRAFT

[76] Inventor: William D. Sauerwein, 4122 Cremson Dr., Phoenix, Md. 21131

[21] Appl. No.: 486,720

[22] Filed: Jun. 7, 1995

[51] Int. Cl.[6] ..... B63B 7/00

[52] U.S. Cl. ..... 114/353; 114/123

[58] Field of Search ..... 114/343, 352, 114/353, 354, 61, 123

[56] References Cited

U.S. PATENT DOCUMENTS

| | | | |
|---|---|---|---|
| 289,208 | 11/1883 | Besosa . | |
| 642,622 | 2/1900 | Mulié et al. . | |
| 1,371,139 | 3/1921 | Banaszak . | |
| 2,093,366 | 9/1937 | Robinson . | |
| 2,157,186 | 5/1939 | Pinter et al. | 114/353 |
| 2,427,772 | 9/1947 | Farish . | |
| 3,068,830 | 12/1962 | Dickerson . | |
| 3,126,558 | 3/1964 | Nolan et al. . | |
| 3,530,519 | 9/1970 | Levinson . | |
| 3,763,511 | 10/1973 | Sisil | 9/1 T |
| 4,024,592 | 5/1977 | Schlagenhauf | 9/1.2 |
| 4,337,543 | 7/1982 | Van Ulzen | 114/354 |
| 4,622,912 | 11/1986 | Bleke | 114/123 |
| 4,768,454 | 9/1988 | Selken | 114/61 |
| 5,052,324 | 10/1991 | Lesly | 114/353 |
| 5,203,276 | 4/1993 | Methven | 114/354 |
| 5,257,594 | 11/1993 | Methven | 114/354 |

FOREIGN PATENT DOCUMENTS

| | | | |
|---|---|---|---|
| 639480 | 5/1962 | Italy | 114/353 |

*Primary Examiner*—Stephen Avila
*Attorney, Agent, or Firm*—Leonard Bloom

[57] ABSTRACT

A rigid watercraft has a three-sectioned hull including a main hull portion and a pair of flotation-sealed outside sponsons at the starboard and port sides thereof. A double-hinge pivot is disposed between each sponson and the main hull portion of the watercraft. The double-hinge pivot has respective pivot axes which are parallel to each other. The watercraft has a first storage or transport position in which the pair of sponsons are folded within the main hull portion, and the watercraft has a second operational position in which the pair of sponsons are pivoted outwardly of the main hull portion of the watercraft, thereby forming a smooth continuation of the hull in the water. The watercraft has a releasable latch between each sponson and the main hull portion of the watercraft. The releasable latch automatically locks each sponson to the main hull portion of the watercraft as the respective sponson has been pivoted outwardly therefrom. The watercraft has a lip formed longitudinally on each sponson and a longitudinal edge on the main hull. The lip presses against the edge on the main hull when the watercraft is in the operational position.

33 Claims, 17 Drawing Sheets

COMPACT SEMI-COLLAPSIBLE WATERCRAFT

The present invention relates to a small watercraft and more particularly, to a small watercraft having port and starboard sponsons which are foldable from a storage position inside a main hull to an operational position outside the main hull.

BACKGROUND ART

A large variety of small watercraft exist in the market today primarily to satisfy consumer needs for easily transportable fishing boats and auxiliary service to larger vessels. This latter group serves a broad spectrum of applications including, but not limited to, emergency use (life boats), transport to and from a larger vessel, and typical recreational activities such as fishing, rowing, and swimming.

A common problem shared by many users of these craft is transport and storage. For those who carry a boat on board a larger vessel, the problem is one of sufficient deck space or space on a swim platform, and the ability to easily and safely launch or retrieve the smaller craft. A good example is trying to pull aboard and stow an eight foot by four foot fiberglass dinghy weighing as much as several hundred pounds. Even the latest high density polyethylene sheet molded dinghies still weigh eighty pounds or more which is difficult to handle in a bulky 4 feet by 8 feet sized package. Inflatable rubberized fabric boats solve the weight problem but do so by trading off reduced interior space, stability and durability. To capitalize on the compact storage capability of inflatable boats require the time consuming process of deflating and reinflating at each use. If left inflated, as is usually the case, especially for those boats with rigid fiberglass bottoms, they do not address the issue of storage space which not only takes up valuable deck space but is often unsightly as well; important considerations to the recreational boater.

Another problem, experienced mainly by fishermen who carry their boat in the back of a pick up truck, van, or station wagon, is the difficulty in fitting a suitable craft into such vehicles. With inflatables being a totally unacceptable option due to disadvantages cited above, the currently popular compromise is the aluminum "john boat". While its narrow beam (width) permits sliding between the wheel wells of a full size pick up, it sacrifices stability and useable interior space.

The applicant is aware of the following U.S. Letters Patents which disclose boats with foldable members which are designed to stabilize the boat and/or reduce the volume of the boat for storage or transport.

| Inventor(s) | U.S. Pat. No. |
|---|---|
| Besosa | 289,208 |
| Mulie et al | 642,622 |
| Banaszak | 1,371,139 |
| Dickerson | 3,068,830 |
| Levinson | 3,530,519 |
| Sisil | 3,763,511 |
| Schlagenhauf | 4,024,592 |
| Van Ulzen | 4,337,543 |
| Bleke | 4,622,912 |
| Selken | 4,768,454 |
| Lesly | 5,052,324 |

The applicant is not aware of any commercially significant implementation of these patents and it is believed that fragility and complexity of the boats and a high potential for water leakage have discouraged their use.

A class of collapsible boats which theoretically provides an acceptably strong and durable structure while giving some measure of reduced size for transport and storage are those which fold in half across the beam into half the length (but twice the height) are disclosed in U.S. Pat. Nos. 5,203,276 and 5,257,594 issued to Malven. These boats occupy the same volume when folded as when in the operating configuration and do not reduce the critical width dimension (beam) to facilitate transportation by the vehicles noted previously.

Another class of boats breaks down into separate pieces which can then be nested together as disclosed in U.S. Pat. No. 2,093,366 issued to Robinson and U.S. Pat. No. 2,427,772 issued to Farish. These boats require a complete and time consuming disassembly that is inconvenient on land and totally impractical on the water.

U.S. Pat. No. 3,126,558 issued to Nolan et al disclose a collapsible boat formed from a number of hull sections interconnected between bow and stern. Each section has a pair of sides and a pair of ends. A separate outrigger member is hingedly connected to each side of each section. Each outrigger member may be folded within the respective hull section. The boat is assembled before being placed in the water.

The present invention provides a structurally sound, unsinkable, rigid watercraft with the seaworthy characteristics of standard length to width ratio marine design while also folding into a transport/storage configuration of approximately one-half its normal volume. Additionally, it accomplishes this by reducing the important width dimension without any disassembly.

SUMMARY OF THE INVENTION

It is an object of the present invention to provide a rigid watercraft which folds to approximately one-half of its operational volume for ease of transport and storage.

It is a further object of the present invention to provide a rigid watercraft which has sponsons that are folded inside the main hull to achieve reduced storage volume without disassembly or tools and which can be deployed from the storage position to the operational position in the water or out of the water.

In accordance with the teachings of the present invention, there is disclosed a rigid watercraft having a three-sectioned hull including a main hull portion and a pair of flotation-sealed outside sponsons at the starboard and port sides thereof. A double-hinge pivot is disposed between each sponson and the main hull portion of the rigid watercraft. The double-hinge pivot has respective pivot axes which are parallel to each other. The rigid watercraft has a first storage or transport portion in which the pair of sponsons are folded within the main hull portion, and the watercraft has a second operational position in which the pair of sponsons are pivoted outwardly of the main hull portion of the watercraft, thereby forming a smooth continuation of the hull in the water.

In further accordance with the teaching of the present invention, the rigid watercraft has releasable latching means between each sponson and the main hull portion of the watercraft.

In still further accordance with the teachings of the present invention there is disclosed a method unfolding the sponsons from the hull and a method of releasing the latching means on each sponson and folding each sponson into the main hull for storage.

These and other objects of the present invention will become apparent from a reading of the following specification, taken in conjunction with the enclosed drawings.

DESCRIPTION OF THE PREFERRED EMBODIMENTS

Figure 1:
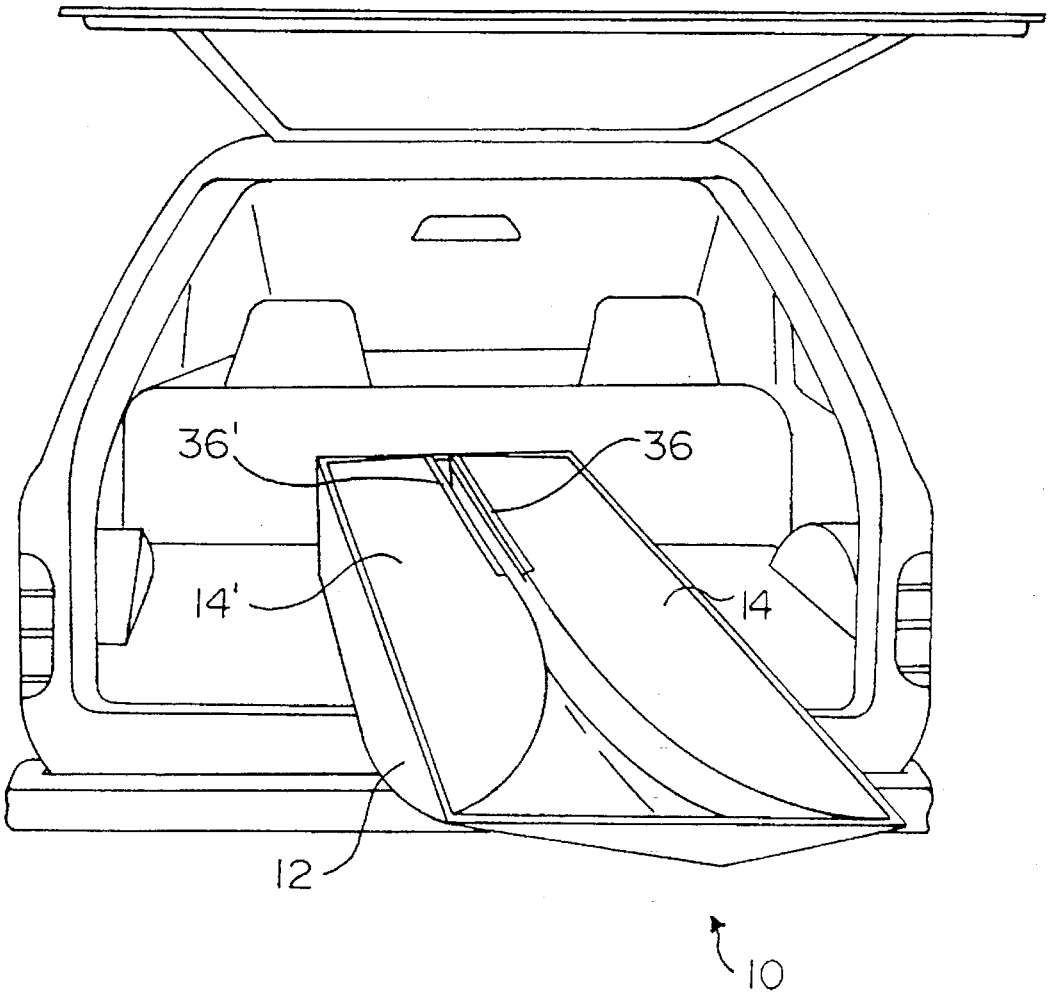
FIG. 1 is a pictorial view showing the removal of the folded watercraft of the present invention from the rear of a vehicle.
Figure 2:
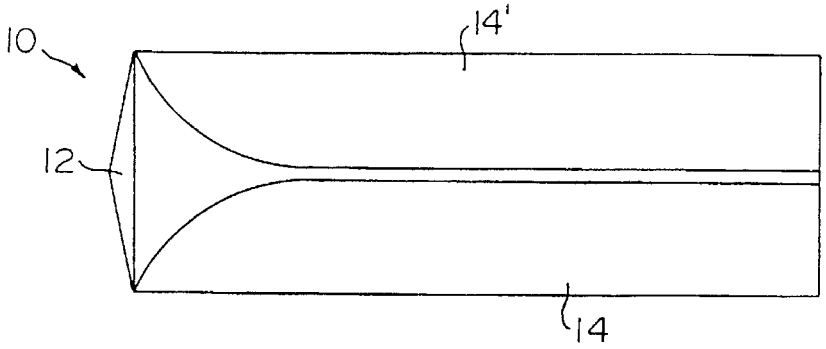
FIG. 2 is a top plan view of the watercraft of the present invention with the sponsons in the storage position.
Figure 3:
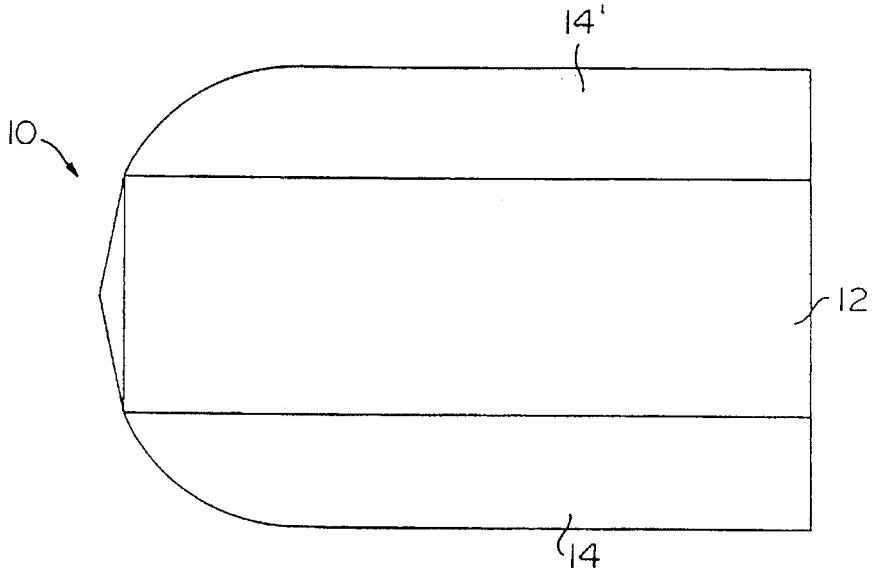
FIG. 3 is a top plan view of the watercraft of the present invention with the sponsons in the operational position.
Figure 4:
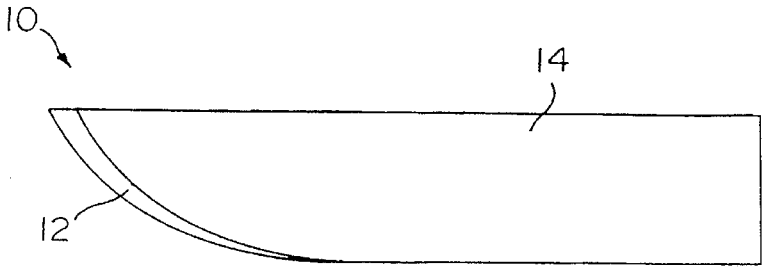
FIG. 4 is a side elevational view of the watercraft of the present position with the sponsons in the operational position.
Figure 5:
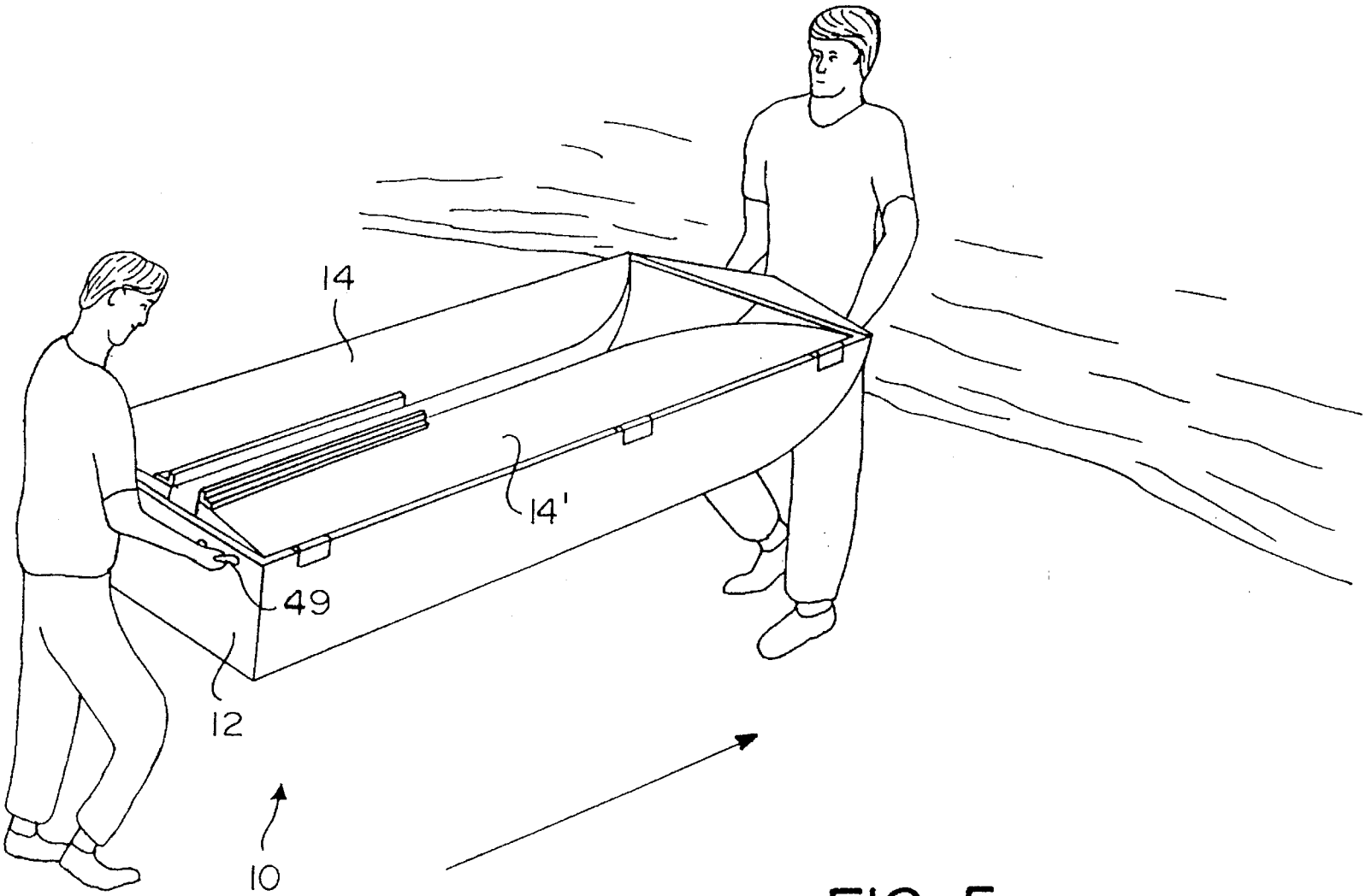
FIG. 5 is a pictorial view showing the folded watercraft of the present invention being carried to the water.
Figure 6:
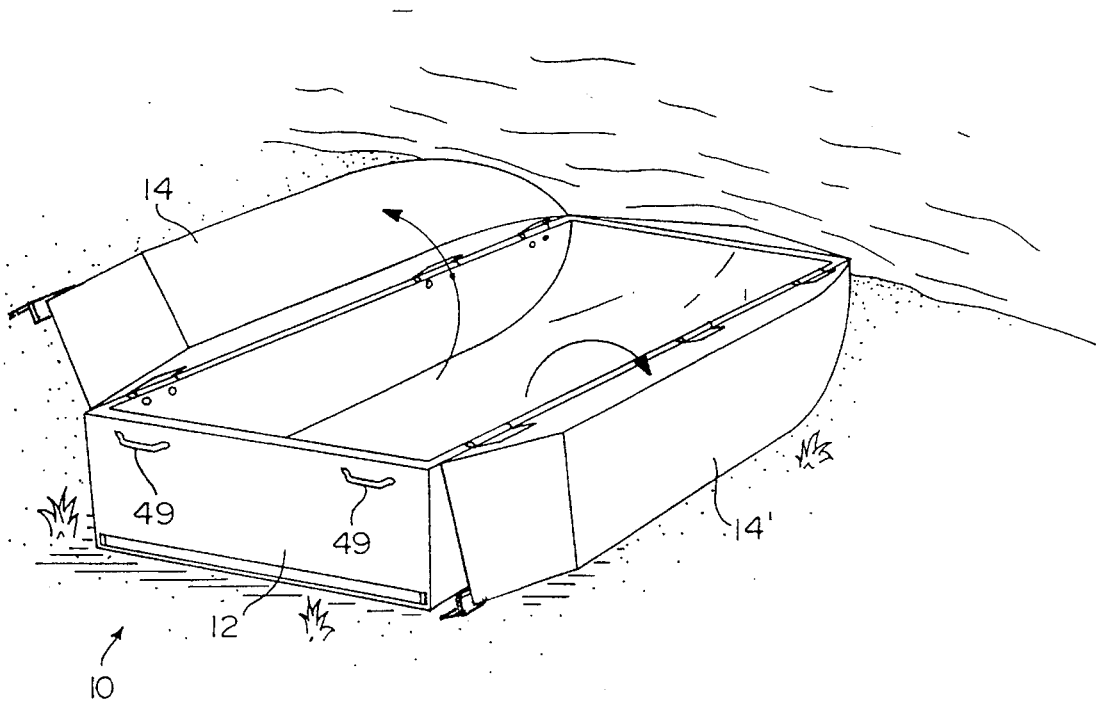
FIG. 6 is a pictorial view showing the unfolding of the sponsons while the watercraft is on land.
Figure 7:
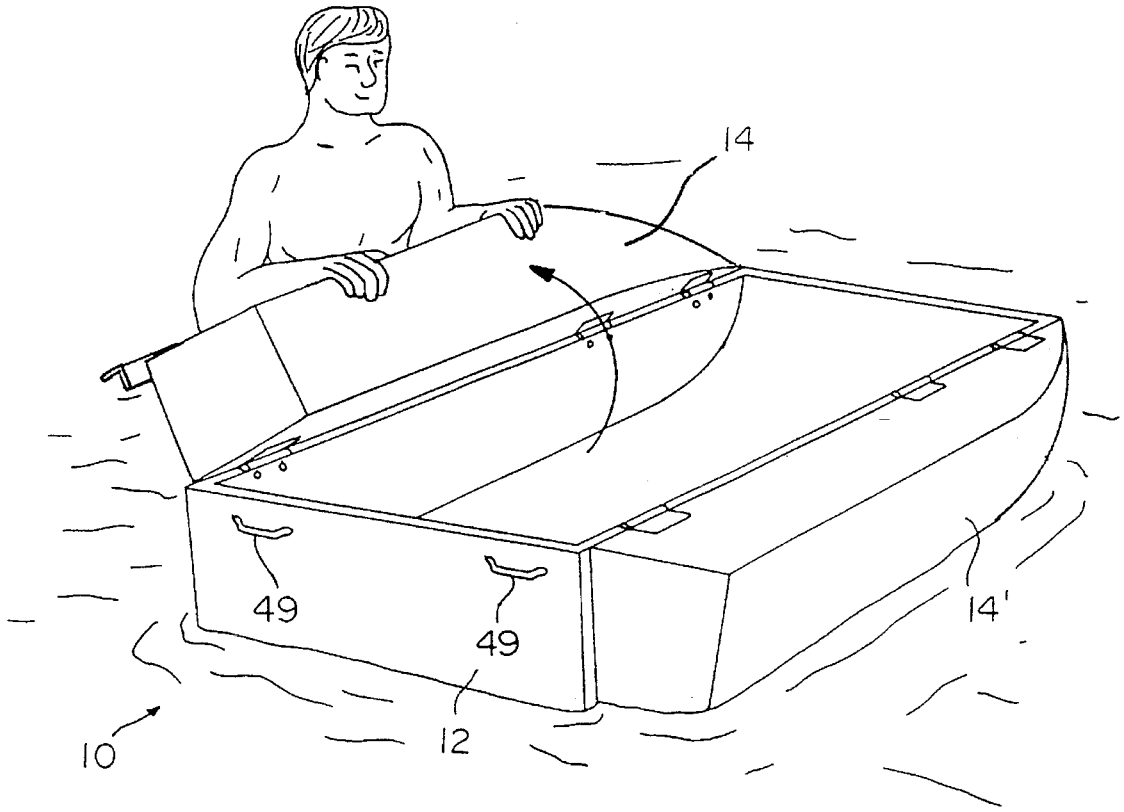
FIG. 7 is a pictorial view showing the process of latching the sponsons while the watercraft is in the water.
Figure 8:
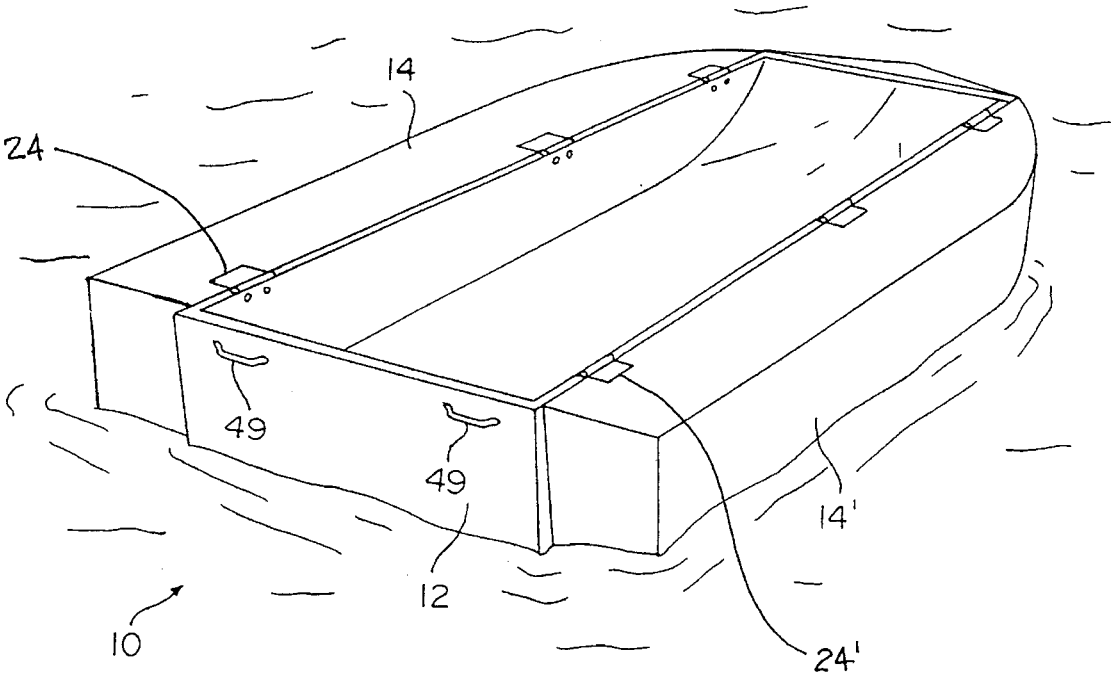
FIG. 8 is a perspective view showing the back of the watercraft in the water in the operational position.
Figure 12:
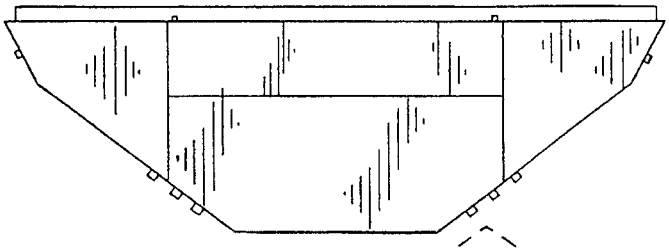
FIG. 12 PRIOR ART
FIG. 12 is a back end view of the prior art boat showing the outrigger members outward.
Figure 13:
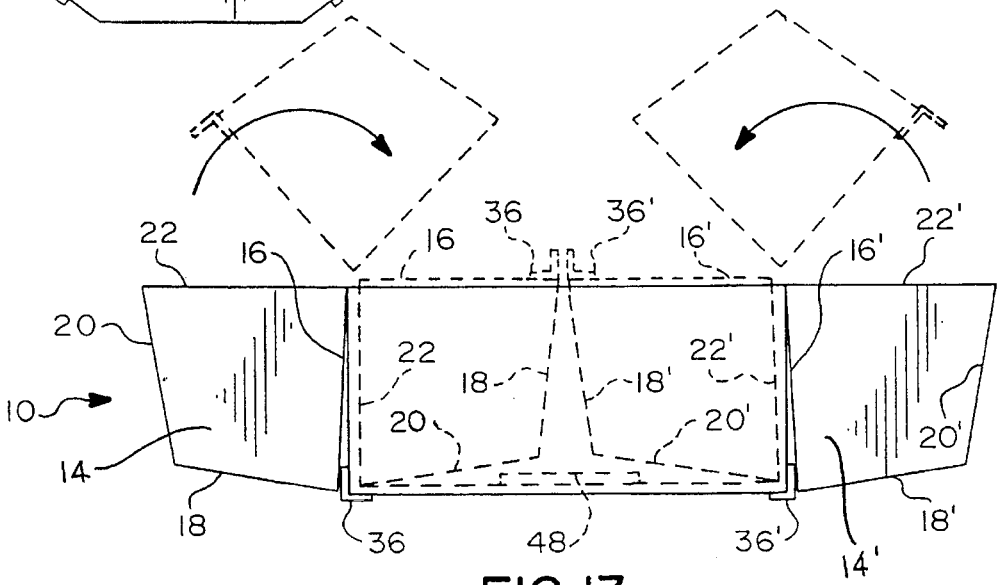
FIG. 13 is a back end view of the present invention showing the sponsons in the operational position with the sponsons in the stored position and in an intermediate position, both shown in broken lines.

Referring now to FIGS. 1–8 the rigid watercraft 10 of the present invention has a main hull 12 having a bow and a stern and port and starboard sides. The watercraft 10 also has a port sponson 14 and a starboard sponson 14'. Each sponson 14, 14' extends substantially the length of the respective sides of the main hull 12. Each sponson 14, 14' is hingably connected to the respective gunwale of the sides of the main hull 12 as will be described. Each sponson 14, 14' is pivotable about the respective hinge such that each sponson 14, 14' may be folded to a first storage position wherein the sponsons 14, 14' are disposed within the main hull 12 and to a second operational position wherein the sponsons 14, 14' are disposed outward of the main hull 12.

Preferably, each sponson 14, 14' may be formed from a variety of structural materials like welded aluminum sheets or molded fiberglass and may be sealed or filled with a buoyant material such as a foamed plastic.

Each sponson 14, 14' has a respective first side 16, 16' which is disposed side-by-side with the outer surface of the main hull 12 in the operational position. When the sponsons 14, 14' are rotated through approximately 270° to the storage position, the respective first sides 16, 16' are disposed across the open top of the main hull 17. The second side 18, 18' of each sponson curves upwardly toward the bow and is disposed in the plane of the bottom of the main hull 12, in the operational position, and thereby, in the shape of the traditional bottom section of a bow, provides good seaworthy characteristics to the watercraft 10. In the storage position, the respective second sides 18, 18' of each sponson are disposed within the main hull 12 and approximately diametrically opposed to one another. The third side 20, 20' of each sponson 14, 14' is outboard and approximately parallel to the sides of the main hull 12 in the operational position. In the storage position, each third side 20, 20' is disposed within the main hull 12 facing the bottom of the main hull 12. The bow portion of the third side 20, 20' of each sponson is curved from the side toward the center line in the bow of the watercraft in the operational position. This cooperates with the curvature of sides 18 and 18' to provide the good seaworthy characteristics of the normally curved and pointed bow sections of a standard rigid hull watercraft. The curvature of the third side 20, 20' also cooperates with the upward curvature of the bottom of the watercraft when the sponsons 14, 14' are in the storage position. The fourth side 22, 22' of each sponson 14, 14' is disposed approximately in a plane with the top of the main hull 12 in the operational position. In the storage position, the respective fourth sides 22, 22' are within the main hull 12 adjacent to the respective port and starboard interior sides thereof. The sponsons 14, 14' may be pivoted between the storage position and the operational position, and in the reverse direction, while the watercraft is in the water or out of the water.

Figure 11:
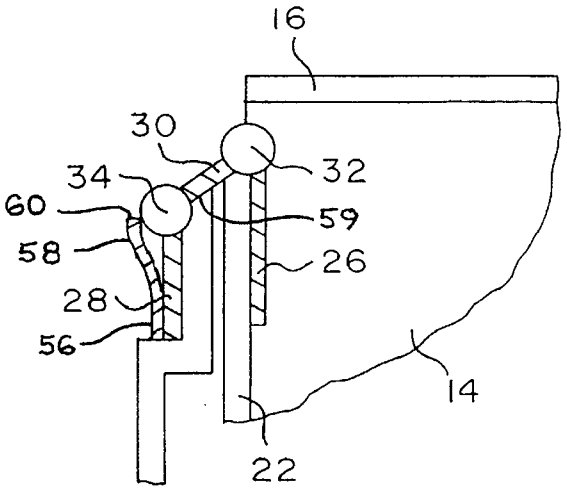
FIG. 11 is an enlarged cross-sectional view of the double pivot hinge showing the sponson folded into the main hull in the storage position.
Figure 10:
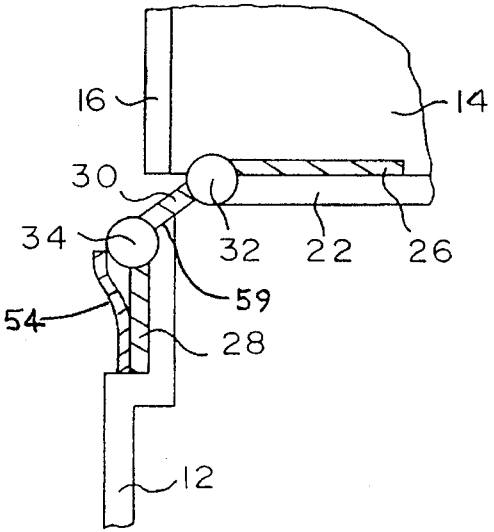
FIG. 10 is an enlarged cross-sectional view showing the double pivot hinge with the sponson partially pivoted.
Figure 9:
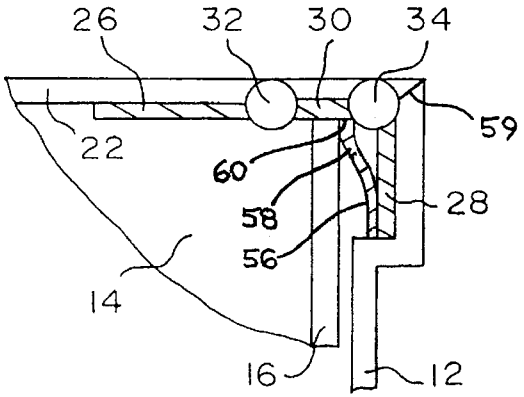
FIG. 9 is an enlarged cross-sectional view of the double pivot hinge showing one of the sponsons folded out of the main hull in the operational position.

Each sponson 14, 14' is pivotally connected to the respective gunwale (the upper edge of the side) of the main hull 12 by at least one articulated double hinge 24, 24' (FIGS. 9–11). Each double hinge 24, 24' has a first plate 26, 26', a second plate 28, 28' and a third plate 30, 30', intermediate between the first plate 26, 26' and the second plate 30, 30'. A first pivot axis 32, 32' with a hinge pin, is disposed between and connected to, the first plate 26, 26' and the intermediate third plate 30, 30'. A second pivot axis 34, 34' with a hinge pin, is disposed between the intermediate third plate 30, 30' and the second plate 28, 28'. The first pivot axis 32, 32' is parallel to the second pivot axis 34, 34' and both pivot axes are substantially transverse to the lengths of the respective hinge plates. Each first plate 26, 26' is connected to the fourth side 22, 22' of the sponson 14, 14' such that the first plate 26, 26' is parallel to and adjoining the fourth side 22, 22' (a preferred but not the only possible position). In the operational position, the first plate 26, 26' in this embodiment is connected to the underside of the fourth side 22, 22' and oriented toward the water thus providing a smooth topside surface 22, 22' for the sponson. When the sponson 14, 14' is pivoted through 270°, the fourth side 22, 22' of the sponson 14, 14' is disposed between the first plate 26, 26' of the hinge 24, 24' and the gunwale and inside wall of the main hull 12.

The second plate 28, 28' of each hinge 24, 24' is connected to and parallel with, the outside of the respective sides of the main hull 12, at the extreme upper edge of the topside (gunwale). Preferably, the second plate 28, 28' is disposed in a depression or offset in the topside at the thickened upper edge of the respective topside forming the gunwale. When the sponsons 14, 14' are in the operational position, the second hinge plates 28, 28' directly confront the first sides 16, 16' of the sponsons. When the sponsons 14, 14' are in the storage position, the first sides 16, 16' of the sponsons 14, 14' are entirely clear of the second hinge plates 28, 28' and are on the opposite sides of the gunwales of the main hull 12 from the second hinge plates 28, 28'.

The third intermediate plate 30, 30' of the hinge 24, 24' has a length shorter than either the first plate 26, 26' or the second plate 28, 28'. The length of the third intermediate plate 30, 30' is greater than the width of the gunwale of the main hull 12 and serves as a bridge between the first pivot axis 32, 32' and the second pivot axis 34, 34'. In this manner, when the sponson 14, 14' is in the operational position, the third intermediate plate 30, 30' extends over, and confronts the edge of the first side 16, 16' of the sponson 14, 14'. As the sponson 14, 14' is rotated through 270° to the storage position, the third intermediate plate 30, 30' rotates about the first pivot axis 32, 32' until the third intermediate plate 30, 30' is inverted, extending over and confronting the top of the gunwale of the main hull 12. While the sponson 14, 14' is being rotated through 270°, the sponson 14, 14' rotates about the first pivot axis 32, 32' approximately 90°until the upper edge of the fourth side 22, 22' clears the respective gunwale and approximately is in a vertical plane. The upper edge adjacent to the hinge contacts the third intermediate plate 30, 30'. The sponson 14, 14' together with the third intermediate plate 30, 30' rotate about the second pivot axis 34, 34' until the full storage position is obtained. To initiate rotation about first pivot 32, 32', torsional springs concentric with pivot axes 32 and 34 could be used to insure smooth sequential action. When fully rotated and in the storage position, the sponson 14, 14' is within the main hull 12 supported by the combination of hinge pivot axes 34, 32, the intermediate plate 30, stop 59, and any other additional supports required such as pads on the main hull deck. The double hinge 24, 24' may be a single unit extending for a length along each sponson 14, 14' but preferably is at least three spaced-apart units, one nearer the stern and the other nearer the bow of the watercraft 10 with the third being intermediate of the bow and the stern.

A stop means 54, 54' is attached to the second plate 28, 28' of each double hinge 24, 24'. Preferably, the stop means 54, 54' is a flat member 56, 56' which is attached to the second plate 28, 28'. The end of the flat member 56, 56' proximal to the second pivot axis 34, 34' has an L-shaped bend formed thereon. The leg 58, 58' of the L-shaped bend is connected to and projects outwardly from the second plate 28, 28' sufficiently for the base 60, 60' of the L-shaped bend to avoid contact with the second pivot axis 34, 34'. The base 60, 60' of the L-shaped bend terminates approximately opposite to the midpoint of the second pivot axis 34, 34'. Other shapes of the stop means 54, 54' may be used, the criteria being that the stop means contacts the intermediate plate 30, 30' and assures that the intermediate plate 30, 30' is at an angle of approximately 90° to the hull side 12 when the sponsons are in the operational position. In this manner, when the respective sponson 14, 14' is in the operational position, the intermediate plate 30, 30' is supported by the stop means 54, 54' at approximately 90° with respect to the side of main hull 12 and second plate 28, 28'. In the absence of the stop means 54, 54', the freedom of movement of the double hinge permits the intermediate plate 30, 30' to be at an angle greater than or less than approximately 90° to hull side 12. As a result, the deployment of the respective sponson 14, 14' with respect to the main hull 12 would not be reproducible and the sponson 14, 14' may be wedged against the main hull 12 instead of lying evenly adjacent to the main hull 12. A further result of the non-reproducible deployment of the sponson 14, 14' would be the non-alignment of the lip 36, 36' with the main hull 12, the importance of which will be described.

As a result of using the above described articulated double hinge 24, 24', the sponson 14, 14' is easily moved between the storage position and the operational position. The gunwale of the main hull 12 has sufficient thickness to support the sponson 14, 14' and provide structural rigidity to the sides of the main hull 12.

The present invention is distinguished from U.S. Pat. No. 3,126,558 issued to Nolan et al in several ways (FIGS. 12–15). First, the boat of Nolan et al is sectionalized raft, being a number of units which are connected to form the assembled boat which can be assembled only on land. Secondly, the hinge means are a single hinge which, because of the thickness of the gunwale on which it is mounted, cannot rotate completely through 270° without serious compromises not described. As the single hinge rotation approaches 270°, the hinge pivot axis contacts the wall of the outrigger member and limits full rotation. In order to increase the angular rotation, the wall of the gunwale, or the wall of the outrigger member, to which the hinge plates are attached, would need to be made thinner. This would reduce the structural strength of the respective walls to a degree such that repeated folding and unfolding would produce a break or damage to the walls. In addition, most single hinges are limited in rotation to approximately 270° because the hinge plates actually contact one another adjacent to the pivot axis prior to rotation through 270°.

Figure 16:
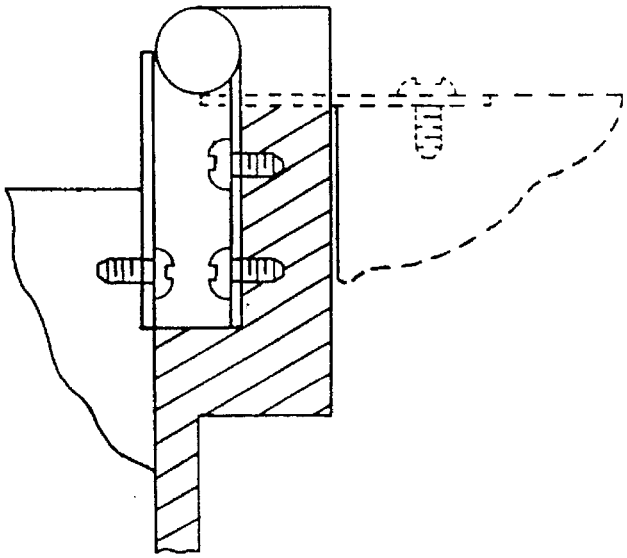
FIG. 16 PRIOR ART
FIG. 16 is a cross-sectional view of prior art showing alternate mounting of the outrigger with the single hinge mounted on the outside of the gunwale.
Figure 17:
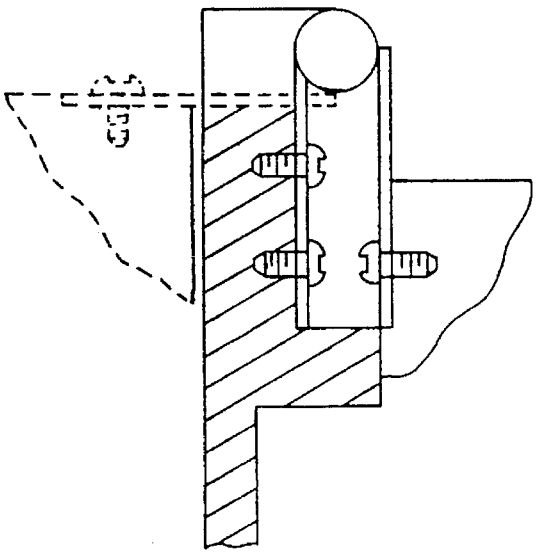
FIG. 17 PRIOR ART
FIG. 17 is a cross-sectional view of the prior art showing alternate mounting of the outrigger with the single hinge mounted on the inside of the gunwale.

A further disadvantage of the single hinge is the reduction in the size of the sponson and hence decreased buoyancy because of the limited rotation capability of the single hinge. In order to obtain increased angular rotation of the single hinge, the outrigger (sponson) may be mounted on the hinge plate distally from the hinge pivot axis as shown in FIG. 16 with the hinge being on the outside of the gunwale. The outrigger is displaced by one inch from the top of the hinge pivot axis to allow for the size of the hinge and the corresponding one inch thickness of the gunwale. Due to the reduced size of the outrigger caused by the displacement, the cross-sectional area of the outrigger is calculated to be reduced by approximately 12.6% per outrigger. Alternately, as shown in FIG. 17, the single hinge may be mounted on the inside gunwale. A reduction in cross-sectional area of the outrigger is calculated to be approximately 12.9% per outrigger. Thus, not only does the single hinge limit rotation, but attempts to increase rotation result in a reduction of cross-sectional areas of the outriggers by approximately 12.6–12.9% for the pair of outriggers on a typical four foot by eight foot watercraft. This is a significant reduction in the buoyancy and stability of the overall boat.

Figure 14:
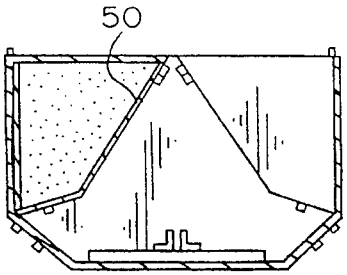
FIG. 14 PRIOR ART
FIG. 14 is a back end view of the prior art boat showing the outrigger members inward.
Figure 15:
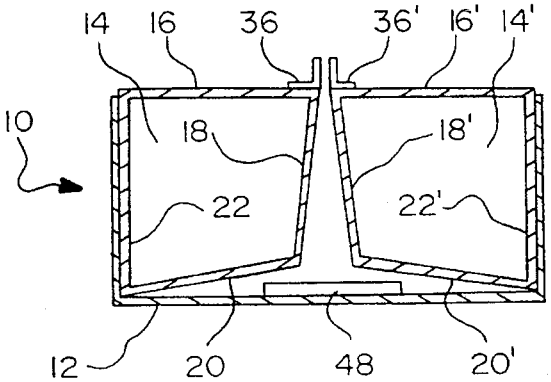
FIG. 15 is a back end view of the present invention showing the sponsons in the stored position.
Figure 18:
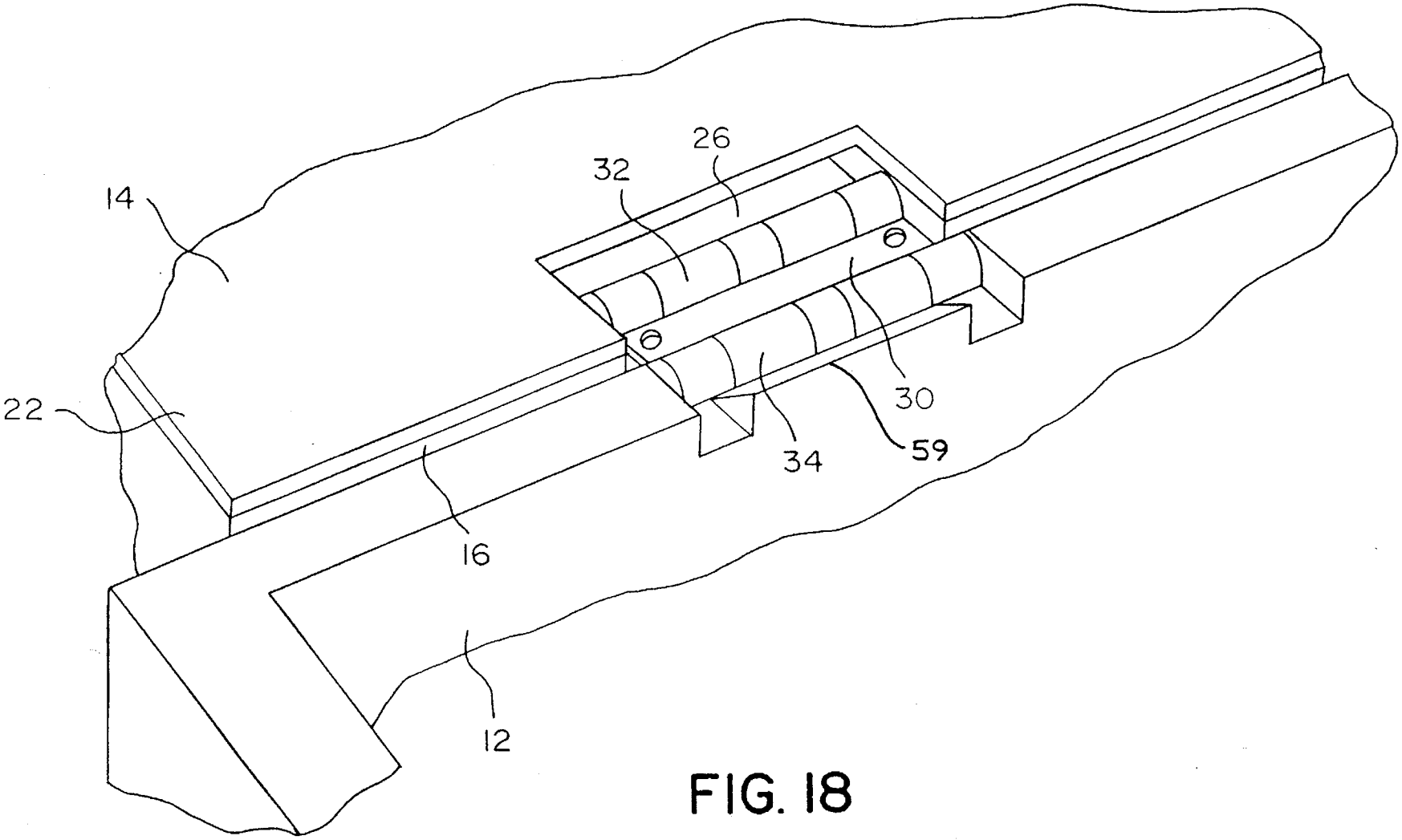
FIG. 18 is an enlarged perspective view of the double hinge with the sponson in the operational position.
Figure 19:
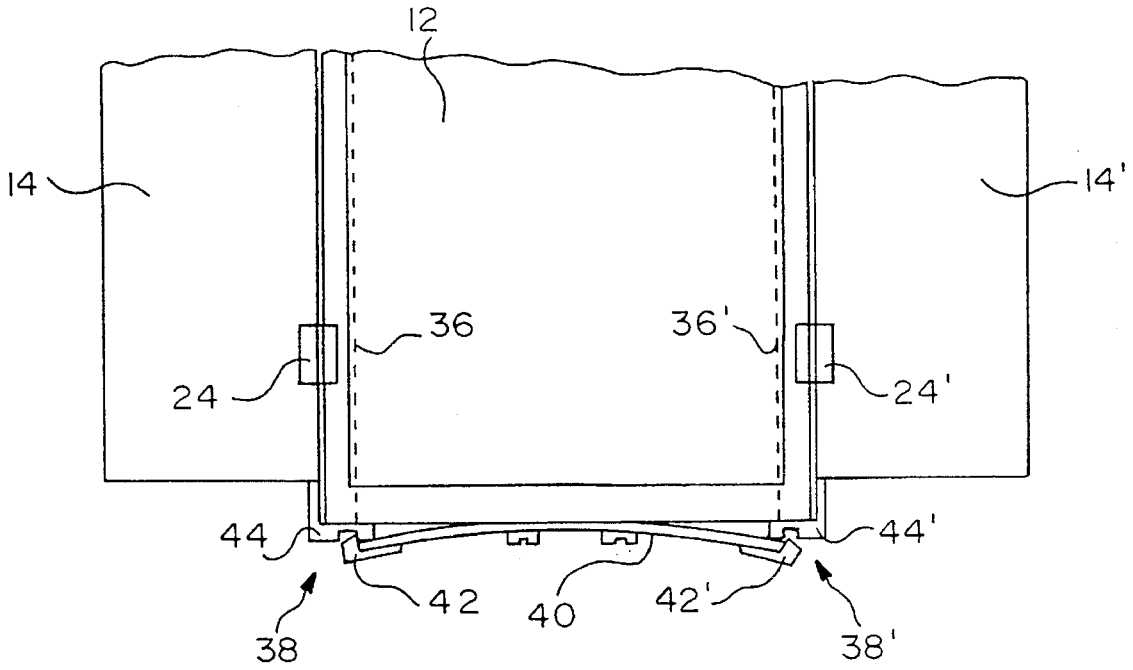
FIG. 19 is a top plan view of the stern of the watercraft showing the releasable latch means connecting the sponsons to the main hull portion.
Figure 20:
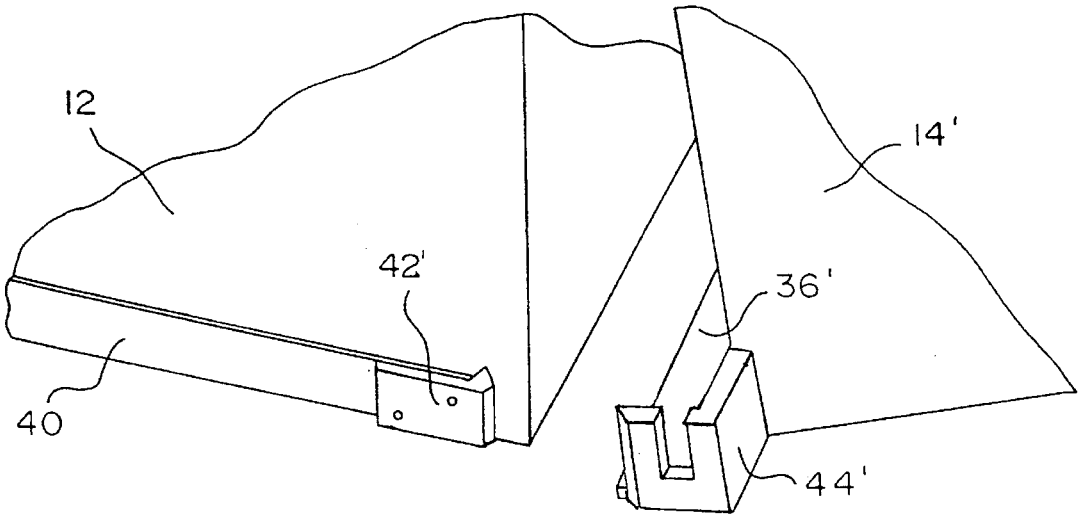
FIG. 20 is a perspective enlarged view showing the lip formed on the sponson and one embodiment of the engaging means and the receiving means of the releasable latch means.

Further, because of the single hinge (as shown in FIG. 14), the size of the outrigger of the prior art is additionally limited in that wall 50 is formed at an acute angle as compared to the approximately 90° angle of the comparable side 18 of the present invention with respect to sidewall 16. The single hinge restricts rotation of the outrigger to the extent that the opposite outriggers would contact one another if the walls were at approximately 90° as in the present invention. Thus, the outriggers of Nolan et al could not be nested in the hull if the structure of the present invention were used. The increased flexibility of the double hinge 24 of the present invention permits use of a sponson having increased volume and hence, increased buoyancy and stability. Moreover, a single hinge has a pivot axis with hinge pin projecting vertically above the top edge of the gunwale to which it is mounted. This vertical projection is above the horizontal surface of the outriggers when the outriggers are disposed outwardly. The pivot axis and hinge pin of each hinge is a protrusion to catch the clothing or the feet of the boater and to interfere with seating on the gunwale. The double hinge 24, 24' disclosed herein has pivot axes 32, 32' and 34, 34' which are substantially flush with the top edge of the gunwale and are safe (FIG. 18).

In a preferred embodiment, a lip 36, 36' is formed extending outwardly from the juncture of sides 16, 16' and 18, 18' of each sponson 14, 14' (FIGS. 1, 5, 13, 15 and 20). The lip 36, 36' is approximately in the plane of the second side 18, 18' and may be a strip fastened to the face of second side 18, 18' or may be an angled strip with the angled portion fastened to the face of first side 16, 16' and could obviously be recessed into side 16, 16'. Preferably, the lip 36, 36' extends the length of the respective sponson 14, 14' from the bow to the stern of the watercraft 10. However, the lip 36, 36' may be a plurality of separated segments spaced apart between the bow and the stern. When the sponson 14, 14' is in the storage position, the lip 36, 36' projects upwardly from the main hull 12. When the sponson 14, 14' is in the operational position, the lip 36, 36' extends under the main hull 12 in a plane parallel to the bottom of the main hull 12. Alternately, a longitudinal edge is formed substantially perpendicular to the respective side of the main hull 12 (and approximately parallel to the surface of the water when the watercraft 10 is in the water). A matching lip 36, 36' is formed on the first side 16, 16' of the respective sponson 14, 14' such that the lip 36, 36' may contact the underside of the longitudinal edge when the sponson 14, 14' is in the operational position. As the pressure of the water is exerted on the second side 18, 18' of the sponson 14, 14' (i.e., the bottom side of the sponson 14, 14' in the operational position), the sponson 14, 14' is pressed upwardly toward the surface of the water pivoting about the double hinge 24, 24' and the lip 36, 36' contacts the under surface on the bottom of the main hull 12 (or the longitudinal edge in the alternate embodiment). The buoyant load distribution is effected across the entire lip 36,36' (as a unitary member or as segmented members). In this manner, the buoyancy of the respective sponson 14, 14' is utilized to retain the sponson 14, 14' in a fully operational position and to prevent water from entering between the main hull 12 and the sponson 14, 14' and tending to separate the sponson 14, 14' from the hull. As opposed to separate connections referenced in other patents, this evenly distributes sponson loads along a substantial length of the main hull eliminating any concentrated load points with their resulting high stresses.

As noted previously, the stop means 54, 54' attached to the second plate 28, 28' of each double hinge 24, 24' assures the proper deployment of the respective sponson 14, 14'. Without the stop means 54, 54' the lip 36, 36' may be spaced apart from and below the bottom of the hull 12 allowing undesirable movement and uneven transfer of the positive buoyancy effect of the sponsons to the main hall. Alternately, the lip 36, 36' may not contact the bottom of the hull 12 but may contact a portion of the side of the hull 12, projecting the bottom of the sponson 14, 14' outwardly from the hull 12 and defeating the added buoyancy effect. The system as described insures a tight, integral, and very strong light weight structure.

Each sponson 14, 14' is secured in the operational position by a releasable latching means 38 (FIGS. 19–22). Preferably, the latching means 38 automatically locks each sponson 14, 14' to the main hull portion 12 when the sponson 14, 14' is in the operational position. Many types of latching means may be used, however, a preferred latching means 38 has a resilient strip 40 mounted transversely on the stern of the main hull approximately parallel to the water line. The first end of the resilient strip is approximately at the port chine of the main hull 12 (i.e., the intersection of the side of the hull and the bottom of the hull) and the opposite second end of the resilient strip 40 is approximately at the starboard chine of the main hull 12. Each end of the resilient strip 40 has an engaging means 42, 42' formed thereon. A cooperating receiving means 44, 44' is formed on each sponson 14, 14' such that when the respective sponson 14, 14' is in the operating position, the respective receiving means 44, 44' and engaging means 42, 42' are in contact with one another. Due to the spring action of the resilient strip 40, the engaging means 42, 42' is held in the receiving means 44, 44'. The latching means 38 permits securing the respective sponsons 14, 14' to the main hull 12 from astern or alongside with the watercraft 10 out of the water, or with the watercraft 10 in the water. When the watercraft 10 is in the water, the person securing the latch can be in the water alongside the watercraft 10 or the person may be inside the watercraft 10. When inside the watercraft 10, the person folds the respective sponson 14, 14, outboard from inside the main hull position 12 and rocks the watercraft 10 or pushes down directly on the respective sponson 14, 14'. Rocking the watercraft 10 reduces the buoyant forces of the water against the respective sponson 14, 14' which is out of the water such that the weight of the sponson 14, 14' causes it to swing in against the side of the main hull 12 and force the receiving means 44, 44' to be secured to the engaging means 42, 42' latching the sponson 14, 14' in place. This automatic securing requires no manual manipulation by the person in the watercraft 10. It is possible to automatically latch a sponson 14, 14' to the main body hull 12 by the person in the watercraft 10 applying weight to one of the sponsons 14 so that the opposite sponson 14' is elevated out of the water. The weight of the sponson 14' and the forces of gravity are sufficient to have the latching means 38' secure the sponson 14' to the main hull portion 12 (FIG. 23).

Figure 21:
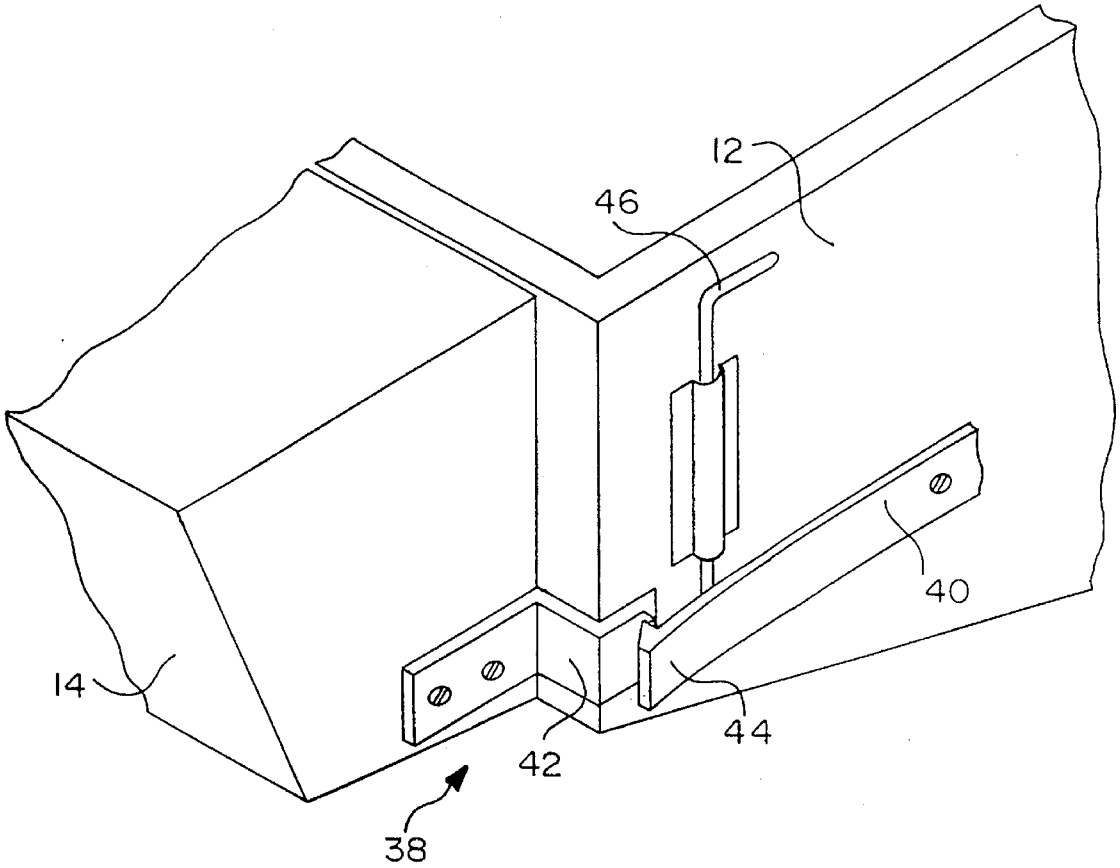
FIG. 21 is a perspective enlarged view showing another embodiment of the releasable latching means and the release means.
Figure 22:
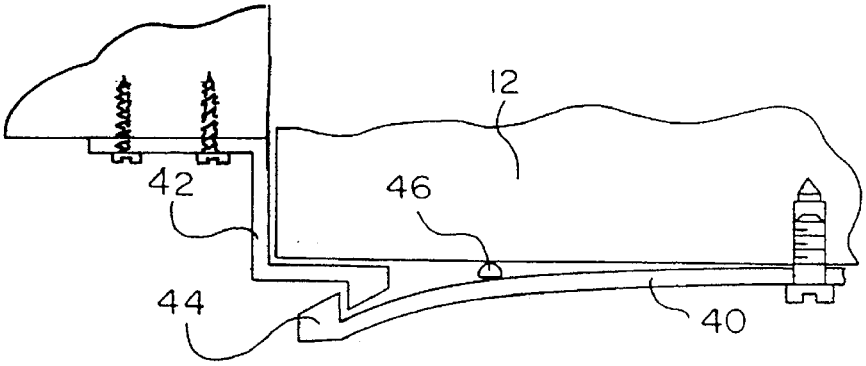
FIG. 22 is a further detail view of the releasable latching means and the release means of FIG. 21 that shows the release cam surface.
Figure 23:
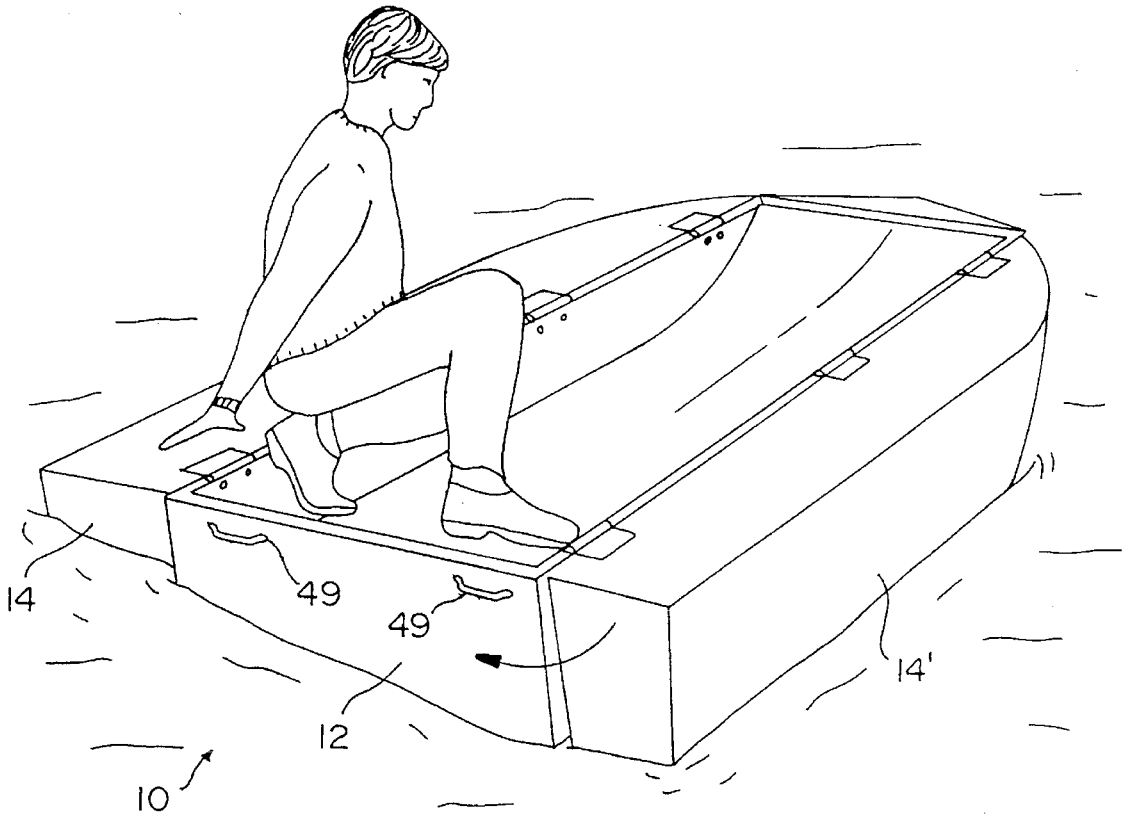
FIG. 23 is a perspective view showing a person applying weight to one sponson and the other sponson being raised and automatically latching.

A release means 46, 46' for the latching means 38 permits the resilient strip 40 to be urged outwardly from the main hull portion 12 such that the engaging means 42, 42' and the receiving means 44, 44' are separated (FIGS. 21–22). A preferred release means 46, 46' is a cam mounted between the main hull portion 12 and the respective ends of the resilient strip 40. Manual rotation of the cam urges the resilient strip 40 outwardly to separate the engaging means 42, 42' from the receiving means 44, 44'. The release means 46, 46' can be activated while the watercraft 10 is in the water or out of the water and while the person is in the watercraft 10 or out of the watercraft 10.

The buoyancy of the sponsons 14, 14' provide superior stability to the watercraft 10 since the sponsons 14, 14' on opposite sides of the hull 12 resist any heeling of the boat between port and starboard.

Figure 24:
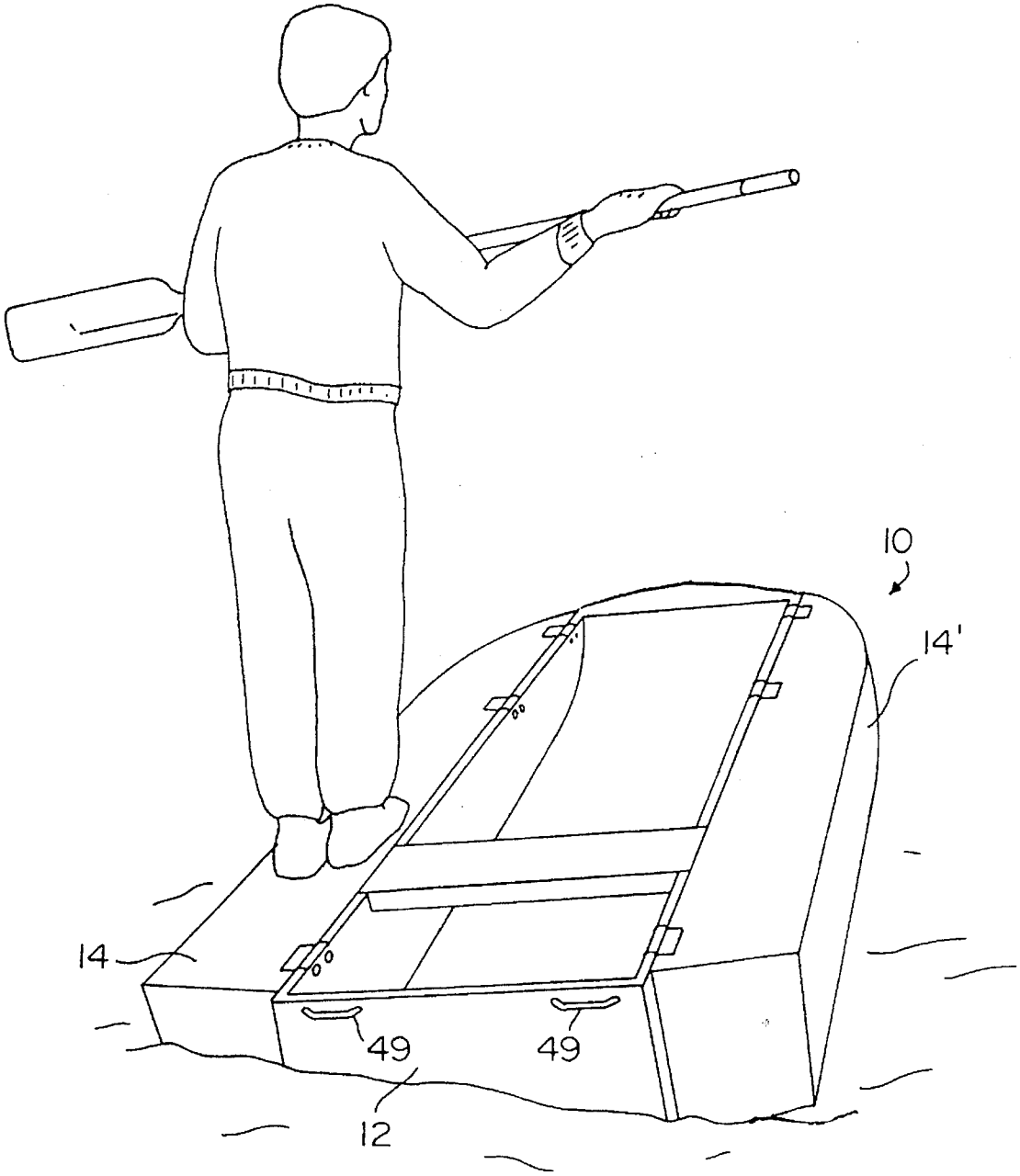
FIG. 24 is a pictorial view showing the watercraft in the water with the sponsons latched in the operational position and a person standing on one sponson without capsizing the watercraft emphasizing the stability advantage of the outboard concentrated flotation.

It is preferred that the angle between the fourth side 22, 22' and the first side 16, 16' of each sponson 14, 14' be slightly greater than 90°. In this manner, when the sponsons 14, 14' are in the operational position, the upper surface of each sponson (the side 22, 22') is angled upwardly and outwardly from the gunwale of the main hull 12. This structure provides (1) increased volume to the sponsons 14, 14' to increase buoyancy, (2) improved comfort for persons within the watercraft 10 to sit on the sponsons 14, 14' and (3) improved resistance to water entering the main hull 12 since the height of the third side 20, 20' of each sponson 14, 14' above the water line is increased. Also, the buoyancy is sufficient to keep the watercraft 10 afloat even under the extreme condition of complete flooding of the open main hull portion 12. Even when the sponsons 14, 14' are not latched to the main hull portion 12, the watercraft 10 is fully seaworthy with a person seated in the watercraft. The watercraft 10 with the sponson 14, 14' secured to the main hull portion 12 does not capsize even when a person stands on one of the sponsons 14 (FIG. 24). The watercraft 10 of the present invention is provided with removable seats 48 which are supported within the main hull portion and seats two persons safely and comfortably. If desired, lifting handles 49 are attached to the bow and stern of the watercraft so the watercraft 10 can be carried.

Figure 25:
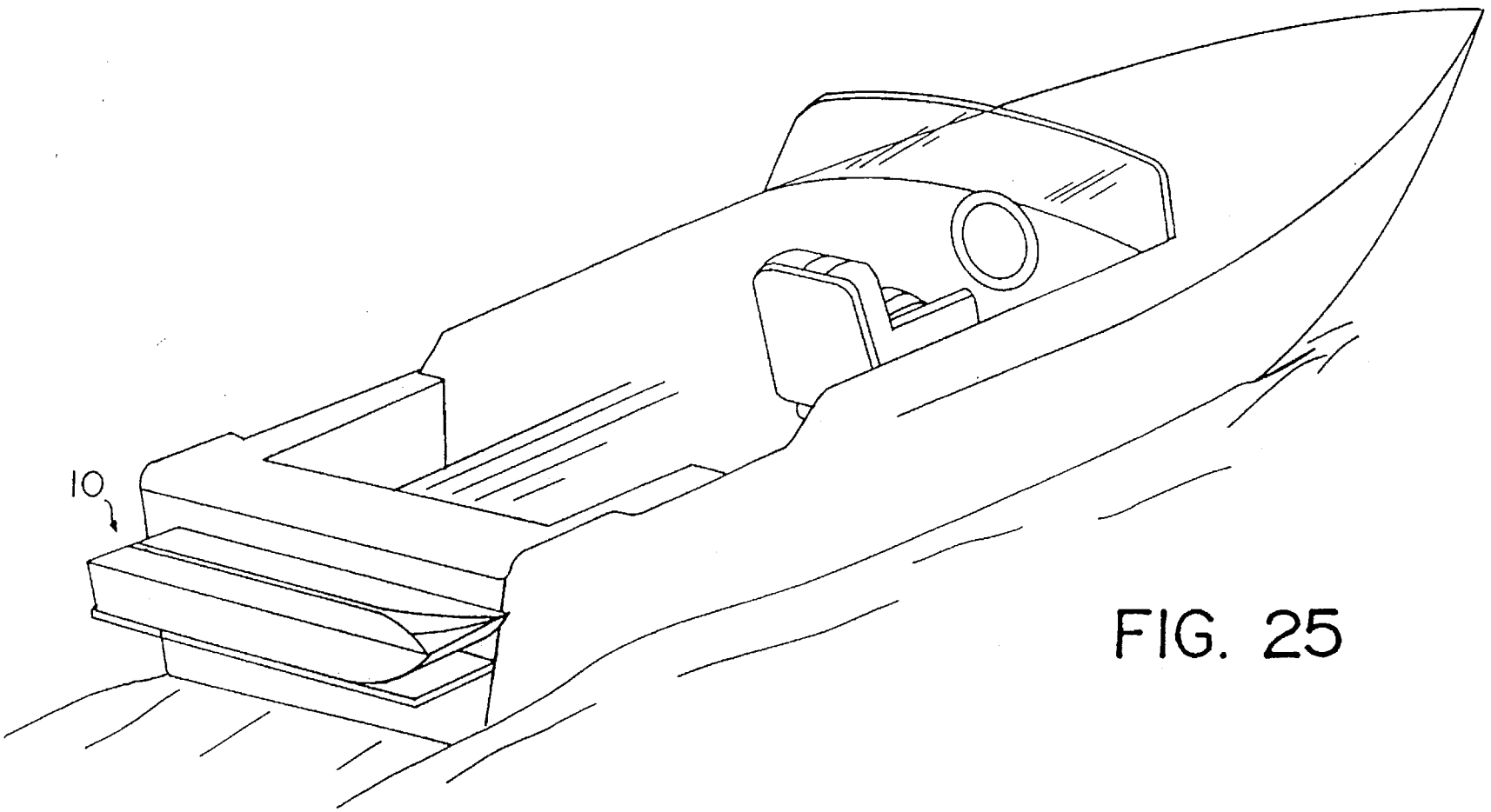
FIG. 25 is a pictorial view showing the folded watercraft stored flat on a platform on the stern of a larger vessel.
Figure 26:
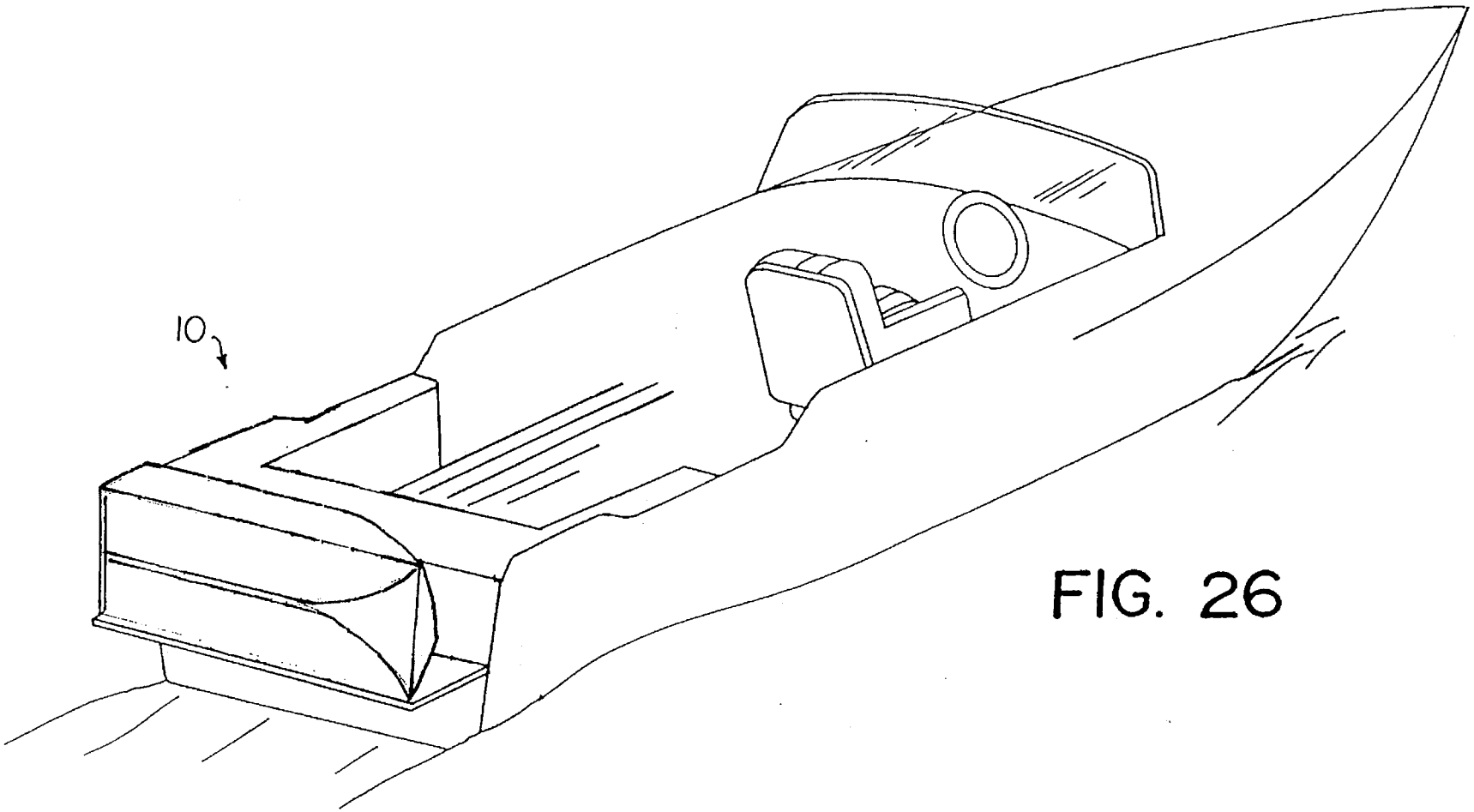
FIG. 26 is a pictorial view showing the folded watercraft being stored on edge on a platform on a stern of a larger vessel.
Figure 27:
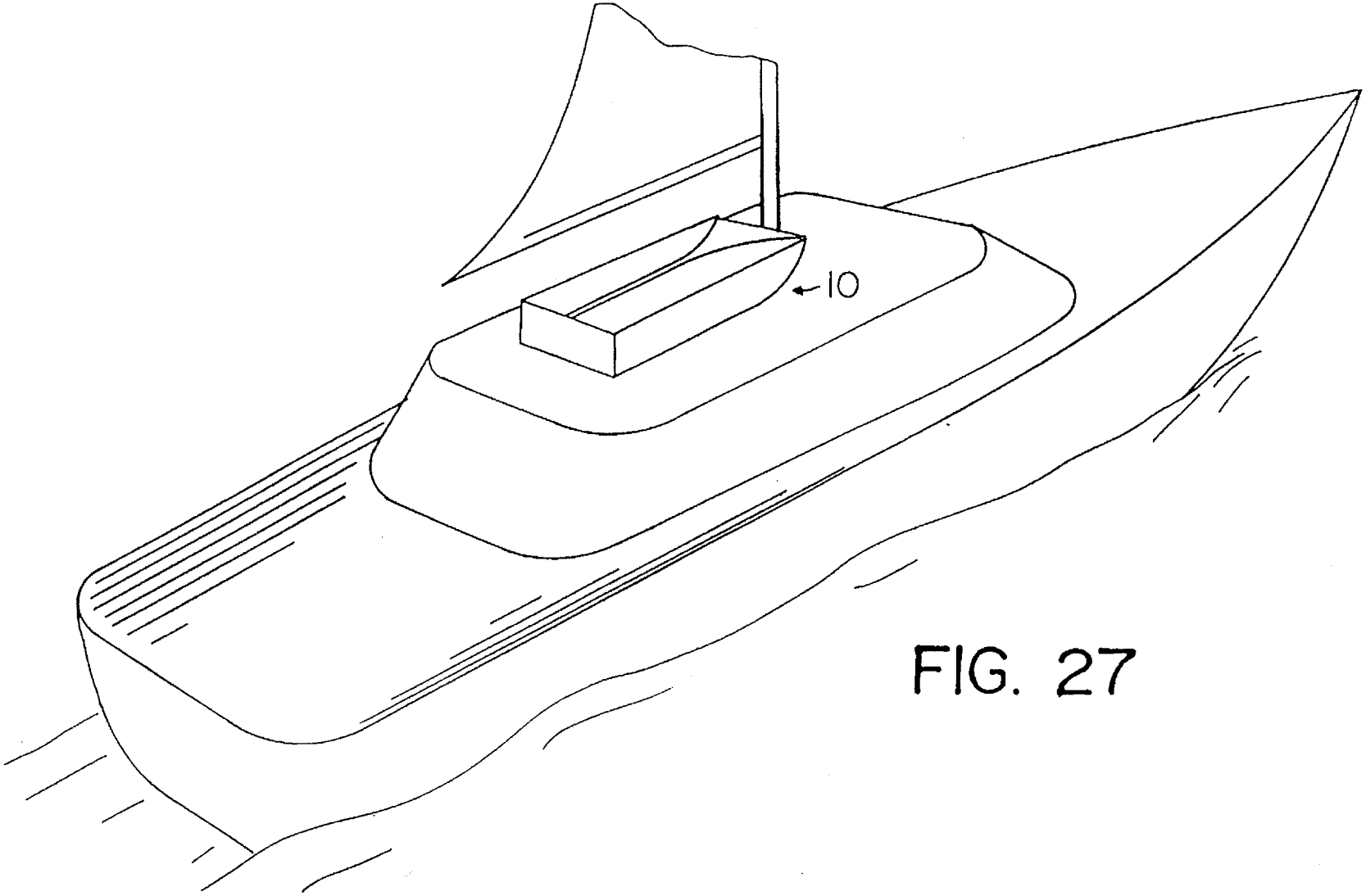
FIG. 27 is a pictorial view showing the folded watercraft being stored on the roof of a cabin of a larger vessel.

The watercraft 10 with foldable sponsons 14, 14' is easily stored horizontally or flat on the swim platform 52 of a larger vessel (FIGS. 25–26) saving space on the deck and avoiding the physical difficulties of lifting a watercraft from the water to the deck of the larger vessel. Even if stored on the cabin of a larger vessel (FIG. 27), the watercraft of the present invention is easier to maneuver into place and occupies less critical deck space than watercraft of the prior art.

The watercraft 10 with the foldable sponsons 14, 14' provides a small boat with reduced storage space required because the sponsons are almost completely stored within the main hull body 12. The width of the watercraft 10 in the operational position is approximately twice the width of the watercraft 10 in the storage position. Due to the storage of the sponsons 14, 14' within the hull portion 12, the height of the watercraft 12 in the operational position is approximately the same as the height of the watercraft in the storage position.

It is preferred that the bow of the watercraft 10 be formed from two sides having a leading edge. From the leading edge, the sides angle toward the respective port and starboard sides of the main hull. The bottom of the main hull portion 12 of the watercraft 10 preferably is angled to the keel but the sponson 14, 14' may be attached to a flat bottomed boat.

The present invention provides a small boat which has a storage position and an operational position, wherein sponsons 14, 14' are nested within the hull portion to reduce the width of the stored boat by approximately one-half without increasing the height of the stored boat. The sponsons 14, 14' are rotated through 270° by pivoting about a double hinge. The sponsons 14, 14' are automatically locked in the operational position. A lip on the sponson 14, 14' utilizes the buoyancy of the sponson 14, 14' to distribute the load along the sponson 14, 14' and secure the watercraft 10 in the operational position. The boat, in its operational position, has superior stability and resistance to flooding. The sponsons 14, 14' can be folded and unfolded without any disassembly or tools and can be done while the watercraft is in the water or out of the water. The sponsons 14, 14', being essentially tubular members contribute great mechanical strength to the sides of the main hull 12. The watercraft 10 of the present invention has no joints or folds beneath the water line which are a potential source of water leakage. The watercraft of the present invention can be manufactured economically with lower costs than the prior art devices.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A rigid watercraft comprising a three-sectioned hull including a main hull portion and a pair of flotation-sealed outside sponsons at the starboard and port sides thereof, at least one double-hinge pivot between each sponson and the main hull portion of the rigid watercraft, the double-hinge pivot having respective pivot axes which are parallel to each other, wherein the rigid watercraft has a first storage or transport position in which the pair of sponsons are folded within the main hull portion, and wherein the rigid watercraft has a second operational position in which the pair of sponsons are pivoted outwardly of the main hull portion of the rigid watercraft, thereby forming a smooth continuation of the hull in the water.

2. The rigid watercraft of claim 1, further including releasable latching means between each sponson and the main hull portion of the rigid watercraft, the releasable latching means automatically locking each sponson to the main hull portion of the rigid watercraft as the respective sponson has been pivoted outwardly therefrom.

3. The rigid watercraft of claim 2, wherein the releasable latching means comprise a receiving means formed on each sponson, the main hull portion having engaging means formed on the respective port and starboard sides thereof, the receiving means on each sponson being releasably connected to the respective engaging means.

4. The rigid watercraft of claim 1, wherein each of the sponsons is pivoted through approximately 270° between the first storage position and the second operational position.

5. The rigid watercraft of claim 1, further comprising a load distribution means connected to each sponson.

6. The rigid watercraft of claim 5, wherein the load distribution means is a lip formed on each sponson and extending outwardly therefrom, the lip contacting the main hull when the sponsons are in the operational position, wherein the buoyancy of the respective sponson presses the respective lip against the hull providing stability to the watercraft.

7. The rigid watercraft of claim 1, further comprising each sponson being filled with a buoyant material.

8. The rigid watercraft of claim 1, further comprising each double hinge pivot having a first plate, a second plate and an intermediate plate therebetween, a first pivot axis being disposed between the first plate and the intermediate plate, a second pivot axis being disposed between the second plate and the intermediate plate, the first plate being attached to a top edge of the main hull and the second plate being attached to the respective sponson.

9. The rigid watercraft of claim 8, wherein the top edge of the main hull has a width, the intermediate plate of the double hinge pivot having a width greater than the top edge of the main hull.

10. The rigid watercraft of claim 8, further comprising each sponson being attached to the main hull by at least three double hinge pivots, one being near the bow, one being near the stern and at least one being at an intermediate point therebetween.

11. The rigid watercraft of claim 8, further comprising a stop means attached to the second plate of each respective double hinge pivot, a portion of the stop means projecting outwardly to approximately a midpoint of the second axis wherein, when the respective sponson is in the operational position, the intermediate plate is supported by the stop means at approximately 90° with respect to the second plate and a side of the main hull.

12. The rigid watercraft of claim 11, wherein the stop means is a flat member attached to the second plate, the flat member having an L-shaped bend formed on one end thereof, a leg of the L-shaped bend being connected to said end and a base of the L-shaped bend extending to the approximate midpoint of the second pivot axis.

13. A method of unfolding the rigid watercraft of claim 2, from the storage position to the operational position comprising the steps of grasping the port sponson and pivoting said sponson through approximately 270° outwardly from within the main hull, the releasable latching means on the port sponson automatically locking the port sponson to the main hull portion, grasping the starboard sponson and pivoting said sponson through approximately 270° outwardly from within the main hull, the releasable latching means on the starboard sponson automatically locking the starboard sponson to the main hull portion.

14. The method of claim 13, wherein the rigid watercraft is out of the water and the sponsons are unfolded prior to placing the rigid watercraft in the water.

15. The method of claim 13, wherein the rigid watercraft is in the water and the sponsons are unfolded.

16. The method of folding the rigid watercraft of claim 2 from the operational position to the storage position comprising the steps of manually releasing the latching means on the port sponson and pivoting the port sponson into the main hull, manually releasing the latching means on the starboard sponson and pivoting the starboard sponson into the main hull.

17. A rigid watercraft having a bow and a stern, the watercraft comprising a three-sectioned hull including a main hull portion having an inwardly and upwardly curved bottom surface in the bow, and a pair of flotation-sealed outside sponsons pivotally connected to the main hull portion of the rigid watercraft at the starboard and port sides thereof, wherein the rigid watercraft has a first storage or transport position in which the pair of sponsons are folded within the main hull position, and wherein the rigid watercraft has a second operational position in which the pair of sponsons are pivoted outwardly of the main hull portion of the rigid watercraft, thereby forming a smooth continuation of the hull in the water, the hull and each sponson having a respective bow portion having a side surface and a bottom surface, the respective side surfaces of the sponsons curving inwardly toward the bow such that in the storage position, the curvature of the respective sponsons cooperates with the curvature of the bottom surface of the main hull and the sponsons are nested within the main hull and such that in the operational position, the sponsons cooperate with the main hull forming a portion of the bow and stern, thereby contributing to the hydrodynamic stability of the watercraft, and releasable latching means between each sponson and the main hull portion of the rigid watercraft, the releasable latching means automatically locking each sponson to the main hull portion of the rigid watercraft as the respective sponson has been pivoted outwardly therefrom.

18. The rigid watercraft of claim 17, wherein each sponson is pivoted outwardly of the main hull portion of the rigid watercraft by approximately 270°.

19. A rigid watercraft comprising a three-sectioned hull including a main hull portion and a pair of flotation-sealed outside sponsons hinged to the main hull portion of the rigid watercraft at the starboard and port sides thereof, wherein the rigid watercraft has a first storage or transport position in which the pair of sponsons are folded within the main hull portion, and wherein the rigid watercraft has a second operational position in which the pair of sponsons are pivoted outwardly of the main hull portion of the rigid watercraft, thereby forming a smooth continuation of the hull in the water, and releasable latching means between each sponson and the main hull portion of the rigid watercraft, the releasable latching means automatically locking each sponson to the main hull portion of the rigid watercraft as the respective sponson has been pivoted outwardly therefrom, and further including a double-hinge pivot between each sponson and the main hull portion of the rigid watercraft, the double-hinge pivot having respective pivot axes which are parallel to each other.

20. A rigid watercraft having respective port and starboard sides comprising a three-sectioned hull including a single unitary main hull portion and a pair of flotation-sealed outside sponsons hinged to the main hull portion of the rigid watercraft at the starboard and port sides thereof, wherein the rigid watercraft has a first storage or transport position in which the pair of sponsons are folded within the main hull portion, and wherein the rigid watercraft has a second operational position in which the pair of sponsons are pivoted outwardly of the main hull portion of the rigid watercraft, thereby forming a smooth continuation from the bow to the stern and from port to starboard of the hull in the water, first cooperating means formed longitudinally on each sponson and second cooperating means formed longitudinally on each side of the main hull portion, wherein, when the sponsons are in the second operational position, the first means and the second means engage one another thereby distributing the buoyancy of the respective sponsons along the length of the main hull.

21. The rigid watercraft of claim 20, further comprising a releasable automatic latching means between each sponson and the main hull portion to secure the respective sponsons to the main hull portion in the operational position.

22. The rigid watercraft of claim 20, wherein the first cooperating means is a lip formed on each sponson and the second cooperating means is an edge formed on the respective sides of the main hull.

23. The rigid watercraft of claim 20, wherein the first cooperating means is a lip formed on the respective sides of the main hull and the second cooperating means is an edge formed on each sponson.

24. The watercraft of claim 21, wherein the latching means is at least one engaging means connected to the respective port and starboard sides of the main hull and at least one cooperating receiving means carried by each of the sponsons.

25. The watercraft of claim 24, further comprising at least one release means, the release means disengaging the respective engaging means from the respective receiving means.

26. The watercraft of claim 25, wherein the at least one release means is mounted on the main hull portion.

27. A rigid watercraft comprising a three-sectioned hull including a main hull portion and a pair of flotation-sealed outside sponsons hinged to the main hull portion of the rigid watercraft at the starboard and port sides thereof, wherein the rigid watercraft has a first storage or transport portion in which the pair of sponsons are folded within the main hull portion, and wherein the rigid watercraft has a second operational position in which the pair of sponsons are pivoted outwardly of the main hull portion of the rigid watercraft, thereby forming a smooth continuation of the hull in the water, a lip formed longitudinally on each sponson and an edge formed longitudinally on each side of the main hull portion, wherein, when the sponsons are in the second operational position, each lip is pressed against the corresponding edge by the buoyancy of the respective sponson, thereby providing stability to the rigid watercraft in the operational position, and wherein the hinge is a double hinge pivot.

28. A rigid watercraft having a bow and a stern, the watercraft comprising a three-sectioned hull including a unitary main hull portion having an inwardly and upwardly curved bottom surface in the bow, and a pair of floatation-sealed outside sponsons at the port and starboard sides thereof, the sponsons extending substantially from the bow to the stern, the sponsons being pivotally connected to a respective side of the main hull wherein the watercraft has a first storage or transport position in which the pair of sponsons are folded within the main hull portion and the watercraft has a second operational position in which the pair of sponsons are pivoted outwardly of the main hull, the hull and each sponson having a respective bow portion having a side surface and a bottom surface, the respective side surfaces of the sponsons curving inwardly toward the bow such that in the storage position, the curvature of the respective sponsons cooperates with the curvature of the bottom surface of the main hull and the sponsons are nested within the main hull and such that in the operational position, the sponsons cooperate with the main hull forming a portion of the bow and stern, thereby contributing to the hydrodynamic stability of the watercraft.

29. The rigid watercraft of claim 28, wherein the main hull has a V-shaped bottom surface.

30. A rigid watercraft comprising a three-sectioned hull including a main hull portion and a pair of floatation-sealed outside sponsons at the port and starboard sides thereof, the sponsons being pivotally connected to a respective side of the main hull wherein the watercraft has a first storage or transport position in which the pair of sponsons are folded within the main hull portion and watercraft has a second operational position in which the pair of sponsons are pivoted outwardly of the main hull, the hull and each sponson having a respective bow portion having side surfaces, the respective side surfaces on each sponson curving inwardly such that in the storage position, the curvature of the respective sponsons cooperates with the curvature of the main hull and the sponsons are nested within the main hull, and wherein each sponson is connected to the main hull by at least one double-hinge pivot.

31. A foldable watercraft having a storage position occupying minimum storage space and having an operational position providing maximum flotation and stability, comprising a unitary hull having starboard side and port side, a pair of sponsons including a starboard sponson and a port sponson, each of which is attached to the hull by pivoting means, the pivoting means having at least two points of rotation, the sponsons being nested within the hull in the storage position of the watercraft, and pivoting outwardly of the hull to a position adjacent to the hull to form a continuation of the hull in the operational position of the watercraft, such that as the sponsons are pivoted outwardly of the hull, the weight of each sponson assists in moving each sponson into position adjacent to the hull, thereby contributing to the stability of the watercraft.

32. The watercraft of claim 31, further comprising automatic latching means between the hull and each sponson, said latching means being operative as each sponson is moved into the operational position of the watercraft, the automatic latching means being manually releasable.

33. The watercraft of claim 31, further comprising first cooperating means formed longitudinally on each sponson and second cooperating means formed longitudinally on each side of the hull, wherein when the sponsons are in the operational position, the first means and the second means engage one another thereby distributing the buoyancy of the respective sponsons along the length of the hull.

* * * * *